United States Patent [19]

Clements et al.

[11] 4,338,210

[45] Jul. 6, 1982

[54] BLEACH COMPOSITION

[75] Inventors: Anthony H. Clements, Clwyd, Wales; Leigh, Arthur G., Merseyside, England

[73] Assignee: Lever Brothers Company, New York, N.Y.

[21] Appl. No.: 237,792

[22] Filed: Feb. 24, 1981

Related U.S. Application Data

[63] Continuation of Ser. No. 176,959, Aug. 11, 1980, abandoned.

[30] Foreign Application Priority Data

Aug. 16, 1979 [GB] United Kingdom ..... 7928589

[51] Int. Cl.[3] ..... C11D 9/42

[52] U.S. Cl. ..... 252/96; 252/95; 252/99; 252/103; 252/DIG. 12; 252/174.12; 8/111; 252/186.38; 252/186.39; 252/186.44; 252/186.1

[58] Field of Search ..... 252/95, 96, 99, 103, 252/186, 174.2; 8/111

[56] References Cited

U.S. PATENT DOCUMENTS

| | | | |
|---|---|---|---|
| 3,822,114 | 7/1974 | Montgomery | 252/95 X |
| 4,011,169 | 3/1977 | Diehl | 252/95 |
| 4,048,085 | 9/1977 | Helsam | 252/95 X |

*Primary Examiner*—Mayer Weinblatt

[57] ABSTRACT

A low temperature bleach system comprises a peracid percursor system and bromide ions. The bromide ions may be supplied by sodium bromide. A theoretical peracid to bromide equivalent ratio between 2:1 and 1:2 is preferred, but dye transfer and hygiene benefits are possible with a ratio up to 1:32. The precursor system is typically diphthaloyl peroxide or sodium perborate plus tetraacetyl ethylenediamine (TAED). If the perborate is in excess, a scavenger such as catalase should be included. The system may be used as such or incorporated in a conventional detergent base.

14 Claims, No Drawings

BLEACH COMPOSITION

This is a continuation, of application Ser. No. 176,959, filed Aug. 11, 1980, and now abandoned.

TECHNICAL FIELD

This invention relates to a bleach system, particularly for fabrics, which is effective at low temperatures. The invention also relates to fabric washing compositions comprising said bleach system which can be used for washing at high temperatures as well as at low temperatures. By the term "low temperatures," temperatures ≦40° C. are meant here.

With the increasing trend of saving energy, housewives are becoming more and more energy-conscious and have gradually changed their washing habit towards lower wash temperatures.

BACKGROUND ART

Inorganic persalts and other percompounds giving hydrogen peroxide in solution, such as sodium perborate and sodium percarbonate, are widely used as a bleaching agent in detergent compositions. These persalts provide a satisfactory bleach when the detergent composition is used at high temperatures, e.g. from 80°–100° C., but their action is rather slow to substantially nil at lower wash-temperature.

It is known that organic peracids, e.g. peracetic acid, are active at lower temperatures and the use of peracid in detergent compositions, either as such or formed in situ, has been suggested to give the detergent composition satisfactory bleaching properties at lower wash-temperatures, e.g. in the 60° C. wash-cycle.

A considerable saving of energy would be obtained if washing habits could be further shifted towards cold and cold water washing, e.g. below 40° C., also for whites.

Unfortunately, however, organic peracids do not exhibit adequate bleaching at these low temperatures.

It is an object of the present invention to provide an improved bleach system which is also effective at temperatures below 40° C.

Another object of the present invention is to provide a bleach composition suitable for use in cold and cool water washing at temperatures below 40° C.

DISCLOSURE OF INVENTION

It has now been found surprisingly that the bleaching action of organic peracids can be enhanced to enable the bleaching of fabrics at low temperatures by using one or more precursors which form an organic peracid in aqueous solution and by the addition of bromide ions. Although the exact mode of action of this specific bromide catalysis is not fully understood, it is believed that bromides, unlike chlorides, react sufficiently rapidly with peracids to form effective amounts of hypobromite. The hypobromite formed is a far superior bleach to peracids and more effective at low temperatures.

As the reaction of bromides with peracids probably involves a nucleophilic attack of bromide ion on the eletrophilic peroxidic oxygen, the rate of reaction will depend on the concentration and reactivities of the bromide and peracid. Though theoretically an equimolar amount of bromide would be necessary for complete conversion of bromide to hypobromite, it has been found that surprisingly a significant improvement of the bleaching effect at low temperatures can already be achieved with less than said theoretical equimolar amount of bromide. An explanation thereof may be that on reaction with certain components of the wash system (including soil components), hypobromites are expected to reform the parent bromide ion according to the following reaction equation:

$$OB1^{\ominus} + \text{wash component} \rightarrow \text{oxidised wash component} + B1^{\ominus}$$

According to the present invention there is provided a bleach composition comprising a peracid precursor or precursors which form an organic peracid in aqueous media and an organic or inorganic material which delivers bromide ions in aqueous media, the theoretical molar equivalent ratio of said organic peracid to said bromide being not more than about 5:1.

BEST MODE OF CARRYING OUT THE INVENTION

For best bleaching results it is preferred that the theoretical molar equivalent ratio of the peracid to the bromide-delivering material lies between 5:1 and about 1:3, most preferably between about 2:1 and about 1:2. However, advantageous effects, particularly a hygiene effect, can be achieved where the peracid precursor(s) is or are present in a relatively minor amount, i.e. where the theoretical molar equivalent ratio of the peracid to the bromide-delivering material lies between about 1:3 and about 1:32. It may be necessary to use the higher proportions of bromide-delivering material in case halogenation of the soil occurs, which consumes bromide ions.

The peracid is formed in situ from its precursor or precursors by hydrolysis or perhydrolysis. In the latter case an organic persalt activator and a persalt of the peroxyhydrate type, e.g. sodiumperborate, can be added separately to the system or composition of the invention. In both cases, whether formed by hydrolysis or perhydrolysis peracid formation takes place in the bleach or wash solution as an intermediary step before the reaction with the bromide. Hence various precursors will fall within the scope of the composition of the invention. These include benzoylperoxide, and diphthaloyl peroxide both of which are capable of generating peracid by hydrolysis. Precursors which generate peracids only on perhydrolysis include esters (such as those described in British Patents 836 988 and 970 950), acylamides (such as N,N,N',N' tetraacetyl ethylene diamine (TAED), Tetraacetyl glycoluril, N,N' diacetyl acetoxy methyl malonamide and others described in British Pat. Nos. 907 356, 855 735, 1 246 339 and US patent 4 128 494), acyl azoles (such as those described in Canadian patent 844 481), acyl imides (such as those described in South African patent 68/6344) and triacyl cyanurates (such as described in US Pat. No. 3 332 882).

In systems comprising an organic precursor and a persalt the organic precursor will advantageously be in at least the stoichiometric ratio to the persalt, since excess of persalt will tend to consume the active hypobromite bleach, unless a persalt bleach scavenger such as catalase is present to remove said excess of persalt.

The bleach system of the present invention can be used as such or it can be used in conjunction with a detergent product for washing and bleaching fabrics. It can be used in relatively short washes as well as in relatively longer soak-washings under room temperature conditions up to 40° C., or at higher temperatures, with much less risk of discolouring dyed fabrics than common commercial chlorine bleaches, e.g. sodium hypochlorite or potassium chloro isocyanurate. It is, moreover, less aggressive to fabrics than chlorine bleaches. A further advantage of the invention is that staining of white fabrics by dye transfer is inhibited.

The bleach system of the invention can be either employed as part of a complete detergent bleach composition comprising any of the usual detergent ingredients or as a separate bleach additive for use in bowl washing or in fabric washing machines. It may be presented in the form of either a powder or granules, a water-soluble or water-permeable unit package, or a tablet.

Hence, the bleach composition of the present invention may comprise a mixture of:

1. from 0.1 to 40 parts, preferably 0.5–35 parts by weight of an organic peracid in the form of its equivalent parts by weight of one or more precursors; and
2. from 0.1 to 40 parts, preferably 0.5–35 parts by weight of a water soluble bromide salt; optionally mixed together with
3. from 0 to 40 parts, preferably 5–35 parts by weight, of a water-soluble organic detergent selected from the group consisting of organic synthetic anionic detergents, nonionic detergents, alkalimetal soaps (e.g. of $C_8$–$C_{22}$ fatty acids), or mixtures thereof;
4. from 0 to 80 parts, preferably 10–60 parts by weight, of a water-soluble builder salt;
5. from 0 to 30 parts, preferably 0–25 parts by weight of fillers; and
6. from 0 to 30 parts, preferably 0.2–20 parts by weight of other suitable adjuncts and ingredients, such as for example N-H compounds such as urea, optical brighteners, soil-suspending agents, dyestuffs, perfumes, enzymes, including proteolytic and amylolytic enzymes and catalase, moisture and mixtures thereof.

Typical synthetic anionic detergents are the alkyl benzene sulphonates having from 8–16 carbon atoms in the alkyl group, e.g. sodium dodedyl benzene sulphonate; the aliphatic sulphonates, e.g. $C_8$–$C_{18}$ alkane sulphonates; the olefin sulphonates having from 10–20 carbon atoms, obtained by reacting an alpha-olefin with gaseous diluted sulphur trioxide and hydrolysing the resulting product; the alkyl sulphates such as tallow alcohol sulphate; and further the sulphation products of ethoxylates and/or propoxylated fatty alcohols, alkyl phenols with 8–15 carbon atoms in the alkyl group, and fatty acid amides, having 1–8 moles of ethoxylene or propylene groups.

Typical nonionic detergents are the condensation products of alkyl phenols having 5–15 carbon atoms in the alkyl group with ethylene oxide, e.g. the reaction product of nonyl phenol with 6–30 ethylene oxide units; the condensation products of higher fatty alcohols, such as tridecyl alcohol and secondary $C_{10}$–$C_{15}$ alcohols, with ethylene oxide, known under the trade name of "Tergitols®" supplied by Union Carbide; the condensation products of fatty acid amide with 8–15 ethylene oxide units and the condensation products of polypropylene glycol with ethylene oxide.

Suitable builders are weakly acid, neutral or alkaline reacting, inorganic or organic compounds, especially inorganic or organic complex-forming substances, e.g. the bicarbonates, carbonates, borates or silicates of the alkalimetals; the alkalimetal ortho-, meta-, pyro- and tripolyphosphates. Another class of suitable builders are the insoluble sodium aluminosilicates as described in Belgian Specification No. 814 874.

It has been discovered that in some bleach systems of compositions comprising an organic peracid precursor and a bromide, the presence of aldehydes, ketones or materials which yield aldehydes or ketones in aqueous solution has a negative effect on bleaching performances. Thus, in preferred embodiments of the present invention such materials are absent or present only up to the extent of one weight part of aldehyde, ketone or material that yields aldehydes or ketones in aqueous solution per 100 weight parts of organic peracid precursor.

Usual fillers are the alkalimetal sulphates, especially sodium sulphate.

A major advantage of the bleach composition of the invention is that it can be used as an energy-saving product in cold and cool water washing of white fabrics with good results.

Bleach compositions according to the invention may be formed by a variety of methods such as dry mixing the components of the composition in any desired order.

EXAMPLE I

Washing experiments were carried out with a detergent base powder of the following composition:

| Base powder composition: | % by weight |
|---|---|
| sodium $C_{12}$~alkyl benzene sulphonate | 18 |
| coconut fatty acid ethanol amide | 2.5 |
| sodium triphosphate | 38 |
| sodium silicate | 9 |
| sodium sulphate | 21 |
| sodium carboxymethylcellulose | 0.4 |
| ethylene diamine-tetraacetate | 0.15 |
| water & salts | up to 100% |

A fixed amount of diphthaloyl peroxide, a precursor forming monoperphthalic acid by hydrolysis in water, was added to the wash solution at each washing; sodium bromide was added in varying amounts.

Washes were carried out isothermally in mechanically stirred glass beakers loaded with tea-stained test swatches. Ingredients were added as quickly as possible in the following order: base powder, bleach, bromide.

The following wash conditions were maintained:

diphthaloylperoxide (DPP) $0.71 \times 10^{-3}$ mole/liter
base powder dosed at 0.4% by weight
water hardness: 18°
15 minutes wash at 40° C.

The obtained bleaching results, measured by the increase in reflectance ($\alpha$R 460) of swatches before and after washing, are set out in Table A.

TABLE A

| | NaBr/NaCl concentration in moles/liter $\times 10^3$ | theoretical ratio peracid:bromide (molar equivalents) | ΔR 460 | Final pH |
|---|---|---|---|---|
| base powder alone | | — | 2.0 | 10 |
| base powder + DPP | | — | 4.0 | 8.1 |

TABLE A-continued

| | NaBr/NaCl concentration in moles/liter × $10^3$ | theoretical ratio peracid:bromide (molar equivalents) | ΔR 460 | Final pH |
|---|---|---|---|---|
| base powder + DPP + NaBr | 0.3 | 2.4:1 | 4.7 | 8.0 |
| base powder + DPP + NaBr | 0.5 | 1.4:1 | 6.0 | 7.9 |
| base powder + DPP + NaBr | 0.71 | 1:1 | 8.5 | 7.8 |
| base powder + DPP + NaBr | 1.0 | 1:1.4 | 10.0 | 7.8 |
| base powder + DPP + NaCl | 0.71 | — | 4.5 | 8.0 |
| base powder + DPP + NaCl | 1.0 | — | 4.8 | 8.0 |

These results show the clear increase in bleaching effect at 40° C. with increasing sodium bromide concentration, in contrast with sodium chloride, which shows hardly any effect.

EXAMPLE II

The results in Table B show the effect of pH from washing experiments carried out with the same base powder under the same washing conditions as in Example I, except that NaBr was used in equimolar amounts to DPP in each wash at varying pH, adjusted by addition of $H_2SO_4$ or NaOH.

TABLE B

| pH | Base powder | ΔR 460 Base powder + DPP | Base powder + DPP + NaBr |
|---|---|---|---|
| 5 | 2 | 4.4 | 9.5 |
| 6 | 2.5 | 4.5 | 9.8 |
| 7 | 2.4 | 5.0 | 10.0 |
| 8 | 2.2 | 5.2 | 7.2 |
| 9 | 2.0 | 3.3 | 4.3 |
| 10 | 1.7 | 2.0 | 2.8 |
| 11 | 1.5 | 2.5 | 3.2 |

EXAMPLE III

Bleaching experiments were carried out at 30° C. under soaking conditions for 2 hours using the following bleach bath with and without bromide and with and without catalase as a percompound scavenger. The results are set out in Table C. The amount of catalase added (*) was such as to give an activity that would be equivalent to the catalase activity necessary to decompose, in 20 minutes at 40° C., 60% of the perborate present in a standard detergent base containing 25% by weight perborate dosed at 0.5%

TABLE C

| TAED g/l | Perborate g/l | NaBr g/l | Theoretical peracid:bromide equivalent ratio | Catalase g/l | TAED:Perborate equiv. ratio | ΔR 460 | Δ (ΔR) |
|---|---|---|---|---|---|---|---|
| 0.34 | 0.23 | — | — | — | 1:0.5 | 3.2 | 1.1 |
| 0.34 | 0.23 | 0.51 | 1:3.3 | — | 1:0.5 | 4.3 | |
| 0.34 | 0.35 | — | — | — | 1:0.75 | 3.1 | 2.2 |
| 0.34 | 0.35 | 0.51 | 1:2.2 | — | 1:0.75 | 5.3 | |
| 0.34 | 0.46 | — | — | — | 1:1 | 4.8 | 6.1 |
| 0.34 | 0.46 | 0.51 | 1:1.7 | — | 1:1 | 10.9 | |
| 0.34 | 0.63 | — | — | — | 1:1.5 | 4.5 | 2.0 |
| 0.34 | 0.63 | 0.51 | 1:1.7 | — | 1:1.5 | 6.5 | |
| 0.34 | 0.92 | — | — | — | 1:2 | 3.8 | 0 |
| 0.34 | 0.92 | 0.51 | 1:1.7 | — | 1:2 | 3.8 | |
| 0.34 | 0.23 | — | — | * | 1:0.5 | 1.4 | 2.5 |
| 0.34 | 0.23 | 0.51 | 1:3.3 | * | 1:0.5 | 3.9 | |
| 0.34 | 0.35 | — | — | * | 1:0.75 | 2.5 | 4.6 |
| 0.34 | 0.35 | 0.51 | 1:2.2 | * | 1:0.75 | 7.1 | |
| 0.34 | 0.46 | — | — | * | 1:1 | 3.3 | 7.6 |
| 0.34 | 0.46 | 0.51 | 1:1.7 | * | 1:1 | 10.9 | |
| 0.34 | 0.63 | — | — | * | 1:1.5 | 3.2 | 7.8 |
| 0.34 | 0.63 | 0.51 | 1:1.7 | * | 1:1.5 | 11.0 | |
| 0.34 | 0.92 | — | — | * | 1:2 | 4.2 | 6.9 |
| 0.34 | 0.92 | 0.51 | 1:1.7 | * | 1.2 | 11.1 | |

ΔR = Bleaching effect based on reflectance data
Δ (ΔR) = Increase in bleaching caused by bromide.

The beneficial effect of catalase on the bleaching results is clearly shown, from bromide containing bleach baths wherein the sodium perborate is present in excessive amounts over the organic precursor (TAED).

EXAMPLE IV

The following experiments demonstrate the effect of a halide-catalysed peracid precursor bleach system in reducing dye transfer. 30 minute washes were carried out on a nylon cloth dyed with C.I. disperse blue 16 together with a clean white non-fluorescent bulked nylon 6,6 dye transfer monitor. Dye transfer was indicated by the reflectance, at 675 nm, of the monitor at the end of the wash. The reflectance of the clean unwashed monitor was 89. Wash conditions (base powder, temperature, water hardness) were otherwise as stated for Example I. The results are set out in Table D.

TABLE D

| TAED moles/l $\times 10^{-3}$ | perborate moles/l $\times 10^{-3}$ | bromide moles/l $\times 10^{-3}$ | theoretical peracid: bromide ratio | R 675 |
|---|---|---|---|---|
| 0 | 0 | 0 | — | 61.3 |
| 1 | 1 | 0 | — | 69.7 |
| 1 | 1 | 2(KBr) | 1:2 | 77.9 |
| 0.5 | 0.5 | 0 | — | 67.3* |
| 0.5 | 0.5 | 2(NaBr) | 1:4 | 74.5* |
| 0.5 | 0.5 | 4(NaBr) | 1:8 | 75.3* |
| 0.5 | 0.5 | 8(NaBr) | 1:16 | 79.0* |
| 0.5 | 0.5 | 16(NaBr) | 1:32 | 82.2* |
| 0.5 | 0.14 | 4.2(NaBr) | 1:30 | 70.8 |
| 0.5 | 0.14 | 4.2(NaBr) | 1:30 | 71.3* |
| 0.5 | 0.43 | 4.2(NaBr) | 1:10 | 75.2 |
| 0.5 | 0.43 | 4.2(NaBr) | 1:10 | 77.0* |
| 0.5 | 0.73 | 4.2(NaBr) | 1:6 | 73.2 |
| 0.5 | 0.73 | 4.2(NaBr) | 1:6 | 78.8* |
| 0.5 | 1.01 | 4.2(NaBr) | 1:4 | 70.1 |
| 0.5 | 1.01 | 4.2(NaBr) | 1:4 | 76.0* |
| 0.5 | 1.30 | 4.2(NaBr) | 1:4 | 70.8 |
| 0.5 | 1.30 | 4.2(NaBr) | 1:4 | 68.3* |

The "*" indicates that catalase was present at the same level as in Example III.

The above Example IV shows that excellent dye transfer results can be obtained with a bleach system according to the invention.

We claim:

1. A bleach composition consisting essentially of (a) a peracid precursor compound which on hydrolysis or perhydrolysis forms an organic peracid, in an amount equivalent to 0.1–40 parts by weight of organic peracid produced therefrom, and (b) 0.1–40 parts by weight of a water soluble bromide salt which delivers bromide ions in aqueous media, the theoretical molar equivalent ratio of said organic peracid to said bromide salt being not more than 5:1, in the substantial absence of aldehydes, ketones and materials which yield aldehydes or ketones in aqueous solution.

2. A bleach composition according to claim 1 wherein said molar equivalent ratio is between about 1:3 and about 1:32.

3. A bleach composition according to claim 1 wherein said precursor is selected from the group consisting of benzoyl peroxide and diphthaloyl peroxide.

4. A bleach composition according to claim 1 wherein said molar equivalent ratio is between bout 5:1 and about 1:3.

5. A bleach composition according to claim 4 wherein said molar equivalent ratio is between about 2:1 and about 1:2.

6. A bleach composition according to claim 1, wherein said precursor is a mixture of an inorganic persalt of the peroxyhydrate type which yields hydrogen peroxide in solution and an organic activator for said presalt selected from the group consisting of esters, acylamides, acylazoles, acylmides, triacyl cyanurvates and mixtures thereof.

7. A bleach composition according to claim 6, additionally including catalase.

8. A bleach composition according to claim 6 wherein said persalt bleach is sodium perborate.

9. A bleach composition according to claim 6 wherein said organic activator is selected from the group consisting of: N,N,N',N' tetraacetylethylenediamine, tetraacetylglycoluril and N,N' diacetylacetoxymethyl malonamide.

10. A bleach composition according to claim 6 wherein said organic activator is present in at least the stoichiometric ratio to the persalt.

11. A bleach composition consisting essentially of (a) A peracid precursor compound which on hydrolysis or perhydrolysis forms an organic peracid, in an amount equivalent to 0.5–35 parts by weight of the organic peracid produced therefrom, (b) 0.5–35 parts by weight of a water soluble bromide salt which delivers bromide ions in aqueous media, (c) 5–35 parts by weight of a water soluble organic detergent selected from the group consisting of organic synthetic sulphonate or sulphate anionic detergents, nonionic detergents, alkalimetaal soaps of $C_8$–$C_{22}$ fatty acids, and mixtures thereof, (d) 10–60 parts of builders from the group consisting of bicarbonates, carbonates, borates or silicates of the alkali metals, the alkali metal ortho-, meta-, pyro- and tripolyphosphates, and insoluble sodium aluminosilicates, and mixtures thereof, said compositions being substantially free from aldehydes, ketones and materials which yield aldehydes or ketones in aqueuos solution.

12. A bleach composition according to claim 11, wherein said precursor is benzoylperoxide or diphthaloyl peroxide.

13. A bleach composition according to claim 11, wherein said precursor is a mixture of an inorganic persalt of the peroxydydrate type which yields hydrogen peroxide in solution, and an organic activator for said persalt, selected from the group consisting of esters, acylamides, acylazoles, acylamides, triacylcyanurates and mixtures thereof.

14. A bleach composition according to claim 13, additionally including catalase.

* * * * *